United States Patent [19]

Kelly

[11] 4,311,177

[45] Jan. 19, 1982

[54] PROCESS FOR REPAIRING A DAMAGED SECTION OF A BOWLING LANE

[75] Inventor: Peter B. Kelly, Bloomfield Hills, Mich.

[73] Assignee: General Electric Company, Coshocton, Ohio

[21] Appl. No.: 174,148

[22] Filed: Jul. 31, 1980

[51] Int. Cl.[3] ..... A63D 1/04; B32B 35/00

[52] U.S. Cl. ..... 144/310 R; 52/126; 144/315 R; 156/98; 273/51

[58] Field of Search ..... 273/51; 52/126; 156/71, 156/92, 94, 98; 144/310 R, 310 B, 314 R, 315 R; 428/63

[56] References Cited

U.S. PATENT DOCUMENTS

| | | | |
|---|---|---|---|
| 2,942,635 | 6/1960 | Horne | 144/310 |
| 4,146,223 | 3/1979 | Stottman | 156/98 |
| 4,169,602 | 10/1979 | Heddon | 273/51 |
| 4,231,573 | 11/1980 | Kelly | 273/51 |
| 4,244,570 | 1/1981 | Murrey, Sr. | 428/63 |

OTHER PUBLICATIONS

"Bowling" Publication, Jan. 1977, p. 6.

*Primary Examiner*—W. D. Bray

*Attorney, Agent, or Firm*—Hedman, Casella, Gibson & Costigan

[57] ABSTRACT

An improved process for repairing a damaged section of a bowling lane comprises removal of the upper planar surface of the bowling lane having the damaged portion therein, and subsequently resurfacing the section with a laminated structure of a specified thickness. Prior to the reinstallation of the section, the exposed substructure of the bowling lane is adjusted by reducing the height thereof, such that when the resurfaced section is replaced, it is flush with the remainder of the bowling lane. Finally, the entire bowling lane is resurfaced, preferably with a decorative laminate surface.

11 Claims, 5 Drawing Figures

PROCESS FOR REPAIRING A DAMAGED SECTION OF A BOWLING LANE

The present invention relates to a new and improved process for repairing a damaged bowling lane, and more particularly, a new and improved process for repairing a bowling lane having a high impact resistance surface.

BACKGROUND OF THE INVENTION

Heretofore, conventional bowling lanes have been constructed of suitably finished hardwood blocks or planking that are mounted on a substructure including longitudinally extending beams, usually 2"×10" in cross-section, and a plurality of transverse beams, usually 2"×4". While wooden lanes have been in use for many years, they are subject to a number of deficiencies, and more particularly, they can be easily and severely damaged in the areas of ball release and at the pin deck. The damage in the ball release area is particularly intensified by lofted bowling balls which, upon impact, dent the lacquered and oiled wooden surface. Surface damage in the pin deck area is primarily caused by contact of the struck pins with the bowling lane surface.

An improved high pressure laminate surface suitable for bowling alley lanes is disclosed in Japanese Application No. SHO-50-111020 laid open for inspection on May 18, 1976 as Publication No. SHO-51-56548, which corresponds to U.S. Pat. Application Ser. No. 506,069, filed Sept. 16, 1974 (now abandoned), the disclosure of which was carried forward in U.S. Patent Application Ser. No. 926,604, filed July 21, 1978. The new and improved bowling lane surfaces have been successfully tested in the United States and have been welcomed as an advance in the art, as exemplified by the publication "Bowling", January, 1977 at page 6.

The new and improved high pressure laminate surface referred to above comprises a bowling lane surface which is a wear and impact resistant decorative plastic laminate having a plurality of thermosetting resin impregnated decorative fibrous print sheets and an overlying melamine resin-containing protective layer. The decorative surfacing is in the form of panels which can be cemented, fixed or suitably adhered to the bowling lane upper substrate layer which can be of wood, hardboard, plywood, flakeboard, chipboard or the like. The laminate surface is so constructed as to approximate the same reaction to ball delivery as wooden lanes.

Although reinforced high pressure laminate surfaces for bowling lanes have been commercially accepted, it has been noted that a problem area arises in the ball impact zone in certain installations.

Fundamentally, it has been found that there are three kinds of ball impact cracks. First, there is the circular or partially circular break which extends through the thickness of the entire plastic laminate. Although this is the most severe form of damage to a lane, it is perhaps the least important because it only occurs under severe misuse of the bowling lane. Bowling balls lofted very high or very far down the lane are the cause. The second kind of impact crack occurs in the back or the bottom portion of the plastic laminate, but does not progress through the laminate to the upper surface of the bowling lane. When an impact crack of this type results from a single impact, it can be seen as a dent in the surface with a linear or star-shaped stress pattern visible in the dent. If it results from a series of less severe impacts, this cracking could only be seen in the back or bottom of the laminate, and its appearance is generally similar to that of mud cracking in a dry lake bed. The third kind of impact cracking occurs predominantly in the normal ball impact area, two feet in back of the foul line to four to five, and possibly as far as eight feet, down the lane. These cracks are single or multiple arcs in the surface of the laminate progressing almost exclusively in the general longitudinal direction of the lane. Upon a close examination of these third types of impact cracks, it is noted that the cracks are only in the upper surface of the laminate, and are stopped from progressing through the entire thickness of the laminate by the glass reinfocement disposed intermediate the depth or thickness of the laminate. It has been determined that the second and third types of impact cracks, usually referred to as shear cracking, is predominantly as a result of loose boards in the substructure supporting the reinforced high pressure laminate.

It has been suggested that correction of a damaged section of a bowling lane could be accomplished by routing down the existing lane and placing a dense one-piece plastic insert into the routed-out recess. However, the router blades would be destroyed by the nails in the boards of the substructure supporting the lane. As an alternative, it has been suggested to cut out a lane section, and replace it with a new identical section. However, the cost involved in the cost of labor and replacement cost of the laminate would be excessive. Also, since years of sanding have left bowling lanes of widely varying thicknesses, this technique would require that the newly manufactured section be either significantly thicker than necessary and sanded or routed flush with the old section, or be raised above the existing substructure by either building the substructure higher or using thick shims which would thus contribute to instability across the lane surface.

Accordingly, it would be desirable to provide a new and improved process for repairing a damaged section of a bowling lane in a quick, efficient, and less costly procedure, and such is the primary object of the subject invention.

SUMMARY OF THE INVENTION

In the process of the subject invention for repairing a damaged bowling lane, including a substrate formed of longitudinally extending support beams and intermediate, transversely extending cross-ties, upon which the planar upper surface of the bowling lane is disposed, the first step in the process is to rough-sand the surface of the bowling lane. Next, two parallel transverse lines are cut into the planar upper surface of the bowling lane to define the intermediate section having the damaged portion of the lane. The damaged section is removed and resurfaced with a laminated structure of a specified thickness. The exposed, transversely extending cross-ties are then removed, and slots are cut into the longitudinally-extending support beams corresponding to the width of the cross-ties, and at a depth corresponding to the specified thickness of the laminated structure which has been resurfaced onto the damaged section. The cross-ties are replaced, after which the resurfaced section is secured to the cross-ties, and the entire planar upper surface of the bowling lane may be refinished with a high pressure laminate surface or, for certain applications, merely a coat of varnish.

DETAILED DESCRIPTION OF THE INVENTION

Figure 1:
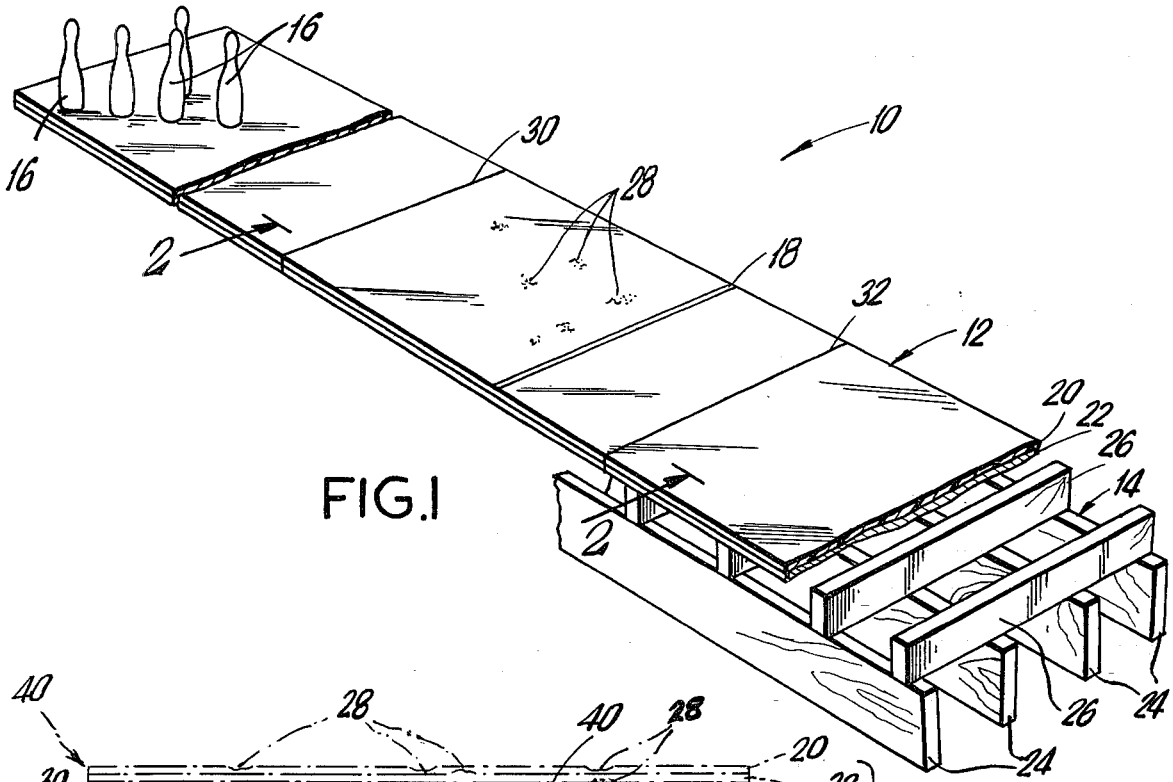
FIG. 1 is a perspective view, partly in section, of a bowling lane having a damaged section, and including two transverse cut lines extending through the surface of the bowling lane according to the process of the subject invention.

Turning to FIG. 1, a bowling lane 10 basically comprises a generally planar upper surface structure 12 and a support substructure 14, with bowling pins 16 being disposed at one end of the lane, while a foul line 18 is disposed at the opposite end. The upper surface structure 12 basically comprises a wear and impact resistant decorative plastic laminate 20 which is bonded to a supporting panel 22 which may be made of wood, hardboard, plywood, flakeboard, chipboard or the like. In turn, the planar upper surface structure 12 is supported by substructure 14 formed of longitudinally extending beams 24 which are usually 2"×10" in cross-section, and intermediate, transversely extending cross-ties 26 which are usually 2"×4" in cross section. As noted above, because of either a poor glue bond between the surfaces 20 and 22, loose boards in the surface 22, or severe misuse of the bowling lane by lofted bowling balls, impact cracks, indicated at 28, may develop in the region immediately downstream of the foul line 18, or upstream of the foul line between the foul line 18 and the pins 16. The subject invention provides a process for repairing the damaged section of the bowling lane 10 in a quick, efficient, and low cost procedure.

Figure 2:
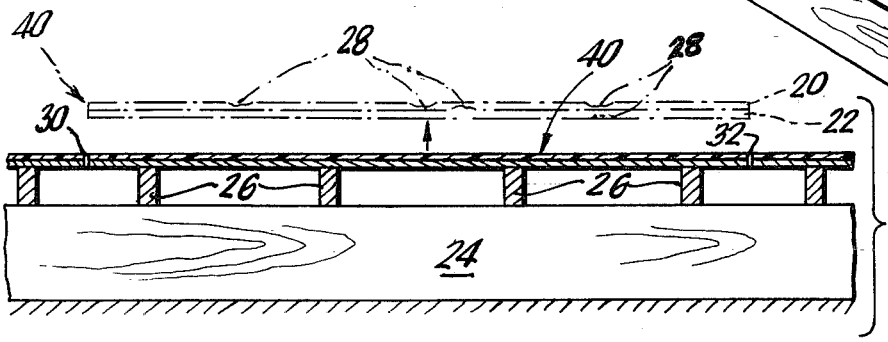
FIG. 2 is a cross-sectional view taken along line 2—2 in FIG. 1 and illustrating the next step in the process according to the subject invention.
Figure 3:
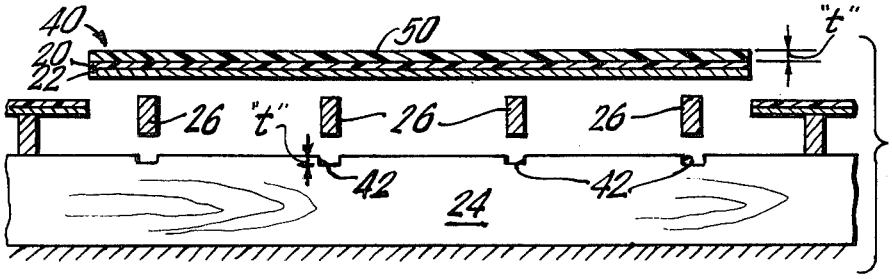
FIGS. 3 and 4 are cross-sectional views similar to FIG. 2, and sequentially illustrating the following steps of the process according to the subject invention.

In the process of the subject invention, the section of the damaged bowling lane is cut out and removed from the lane. To this end, transverse, generally parallel cuts 30 and 32 are made through the generally planar upper surface 12 using a diamond, masonry, or other saw which will satisfactorily cut through the surface 12 and any nails which might be encountered. Preparatory to cutting the bowling lane along cuts 30 and 32, the entire upper surface of the bowling lane 10 may be rough sanded, and if there is an excessive amount of oil on the surface, the surface may be first dried using a conventional powdered oil absorbent. As shown in FIG. 2, the cut lines 30 and 32 only extend through the planar upper surface 12, and more particularly, through the plastic laminate 20 and the lower support panel 22. The section of the generally planar upper surface 12 intermediate the cut lines 30 and 32 is then removed, and is designated in FIG. 2 by the numeral 40. The damaged section 40 is resurfaced with a hard, dense and tough material 50 such as flakeboard, particleboard, an all kraft-plastic laminate, or a reinforced high pressure laminate, similar to laminate 20 of surface 12. The thickness of the sheet material 50 is designated "t" in FIG. 3. In the subject process, lines are drawn on top of the exposed longitudinal 2"×10" supports 24 on either side of the 2"×4" cross-ties 26 which have been exposed by removal of the section 40. Next, slots 42 corresponding to the width of the cross-ties 26 are cut into the longitudinal support beams 24 to a depth designated "t" which is equal to or very slightly less than the thickness of the sheet material 50 which is fixed to the upper surface of the cut-out section 40. Preferably, the sheet material 50 is both mechanically and adhesively bonded to the upper surface of the cut-out lane section 40. If, for example, the new surface 50 is one-half inch thick high density particleboard, an adhesive that doesn't require pressure (such as epoxy, urethane, etc.) would be applied to either the particleboard surface 50 or the section 40, and the two surfaces held together mechanically with screws. In order to eliminate the possibility of the screws backing out, they could be counter-sunk and capped with adhesive or a wooden plug-adhesive combination. As an alternative, in order to obtain even greater bonding of the surfaces, a hole may be drilled for the screw, the hole then countersunk and filled with adhesive, and the screw then inserted and capped with further adhesive or a wooden plug. Thus, using the mechanical fastening, the composite structure of the section 40 and the sheet material 50 may be reassembled on the substructure 14 before the adhesive sets.

Figure 4:
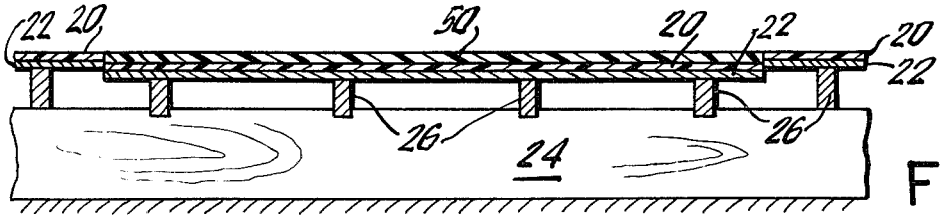

In the next step of the process of the subject invention, as shown in FIG. 4, the cross-ties 26 are placed in the slots 42 in the supports 24 and fixed in place, such as by nailing. The resurfaced lane section 40, 50 is then secured to the cross-ties 24 by mechanical means, such as screws, or by a combination of mechanical means and adhesive. The saw kerfs or cut lines 30, 32 between the resurfaced section 40, 50 and the remainder of the planar upper surface structure 12 may be filled with a suitable material, or alternatively, may be left open to allow for thermal expansion or contraction of the bowling lane.

Figure 5:
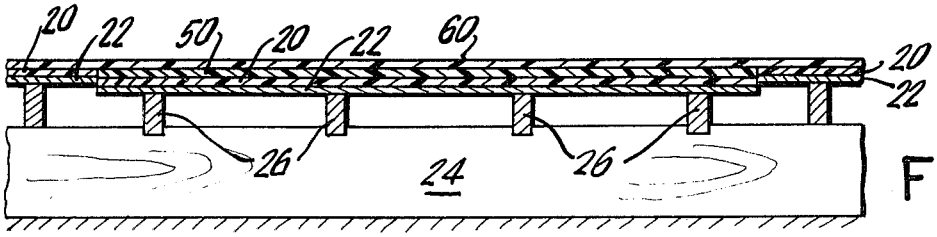
FIG. 5 is a view similar to FIG. 2 and illustrating the final construction of the bowling lane made according to the process of the subject invention.

In the final step of the process of the subject invention, the entire upper surface of the bowling lane, including sheet material 50, is lightly sanded, after which the entire planar upper surface of the bowling lane is resurfaced with a high pressure laminate surface 60 (see FIG. 5). Surface 60 is preferably a wear and impact resistant decorative plastic laminate having a plurality of thermosetting resin impregnated decorative fibrous print sheet and an overlying melamine resin-containing protective layer. The decorative surfacing is in the form of panels which may be cemented, fixed or suitably adhered to the upper surface of the lane, including the repaired section.

Accordingly, there is provided a new and improved process for repairing a damaged section of a bowling lane including the step of rough-sanding the surface of the bowling lane, followed by cutting out the section of the planar upper surface of the bowling lane containing the damaged portions. The cut section is removed and resurfaced, preferably with a laminated or a wear and impact resistant decorative plastic laminate of a specified thickness. In order to adjust the exposed substrate support structure of the bowling lane to accommodate the additional thickness of the plastic laminate on the resurfaced section, slots are cut into the main support beams corresponding to the width of the cross-ties and to a depth corresponding to the thickness of said plastic laminate. The cross-ties are reassembled to the support structure, after which the resurfaced section is fixed to the cross-ties. Finally, the entire upper surface of the lane is lightly sanded, and completely resurfaced, again preferably with a wear and impact resistant decorative plastic laminate.

The present invention has been described in the above specification with reference to a specific embodiment, and such reference has been made for purely illustrative purposes only, and various modifications in the detail included therein may be made without departing from the scope or spirit of the invention as defined by the following claims.

I claim:

1. A process for repairing a damaged bowling lane including a support substructure and a planar upper surface forming the bowling lane, said process comprising the steps of:

(a) cutting and removing the section of the planar upper surface having the damaged portion therein;
(b) resurfacing said section with a hard, dense, tough sheet material to resist ball drop deformation;
(c) adjusting, by reducing, the height of the substructure to permit the flush reinsertion of the resurfaced section into the bowling lane; and
(d) resurfacing the entire planar upper surface of the bowling lane.

2. A process for repairing a damaged bowling lane including a support substructure and a planar upper surface forming the bowling lane as recited in claim 1 in which said damaged section is resurfaced with a wear and impact resistant decorative plastic laminate.

3. A process for repairing a damaged bowling lane including a support substructure and a planar upper surface forming the bowling lane as recited in claim 2 wherein the entire planar upper surface of the bowling lane is resurfaced with a wear and impact resistant decorative plastic laminate.

4. A process for repairing a damaged bowling lane including, in turn, a base substructure formed of longitudinally-extending support beams, an intermediate support structure of transversely extending cross-ties, and a planar upper surface forming the bowling lane, said process comprising the steps of:

(a) cutting the planar upper surface of the bowling lane along two generally parallel, transverse lines to define an intermediate section of the planar upper surface of the bowling lane including the damaged portion thereof;
(b) removing said section of the bowling lane;
(c) resurfacing said section with a sheet material of a specified thickness;
(d) removing the transversely-extending cross-ties which are exposed by removal of said damaged section;
(e) cutting slots corresponding to the width of the cross-ties in the longitudinally-extending support beams at the intersections thereof, said slots being of a depth corresponding to the thickness of the reinforcing sheet material;
(f) placing said cross-ties in said slots and fixing said cross-ties to the base substructure;
(g) replacing said resurfaced section in said bowling lane and securing said resurfaced section to said exposed cross-ties; and
(h) resurfacing the resulting planar upper surface of the bowling lane.

5. A process for repairing a damaged bowling lane including a support substructure and a planar upper surface forming the bowling lane as recited in claim 4 in which said parallel transverse cut lines extend perpendicular to the longitudinal axis of the bowling lane.

6. A process for repairing a damaged bowling lane including a support substructure and a planar upper surface forming the bowling lane as recited in claim 4 in which said cross-ties are fixed to said base substructure by nailing.

7. A process for repairing a damaged bowling lane including a support substructure and a planar upper surface forming the bowling lane as recited in claim 1 in which the resulting planar upper surface of the bowling lane is resurfaced with a wear and impact resistant decorative plastic laminate.

8. A process for repairing a damaged bowling lane including, in turn, a base substructure formed of longitudinally-extending support beams, an intermediate support structure of transversely-extending cross-ties, and a planar upper surface forming the bowling lane, said process comprising the steps of:

(a) rough-sanding the surface of the bowling lane;
(b) cutting the planar upper surface of the bowling lane along two generally parallel transverse lines to define an intermediate section of the planar upper surface of the bowling lane including the damaged portion thereof;
(c) removing said section of the bowling lane;
(d) resurfacing said section with a laminated structure of a specified thickness;
(e) removing the transversely-extending cross-ties which are exposed by removal of said section of the upper surface of the bowling lane;
(f) cutting slots corresponding to the width of the cross-ties in the longitudinally-extending support beams at the intersections thereof, said slots being of a depth corresponding to the thickness of the laminated structure;
(g) placing said cross-ties in said slots and fixing said cross-ties to the base substructure;
(h) replacing said resurfaced section in said bowling lane and securing same to said exposed cross-ties; and
(i) resurfacing the resulting planar upper surface of the bowling lane.

9. A process for repairing a damaged bowling lane as recited in claim 8 in which said parallel transverse cut lines extend perpendicular to the longitudinal axis of the bowling lane.

10. A process for repairing a damaged bowling lane as recited in claim 8 in which said cross-ties are secured to said support beams by nailing.

11. A process for repairing a damaged bowling lane as recited in claim 8 in which the resulting bowling lane surface is resurfaced with a decorative plastic laminate.

* * * * *